US010717012B2

(12) United States Patent
Keller et al.

(10) Patent No.: US 10,717,012 B2
(45) Date of Patent: Jul. 21, 2020

(54) ROTATING PLAY DEVICE

(71) Applicant: Landscape Structures Inc., Delano, MN (US)

(72) Inventors: Thomas L. Keller, Delano, MN (US); Matthew A. Tschann, Watertown, MN (US)

(73) Assignee: Landscape Structures Inc., Delano, MN (US)

( * ) Notice: Subject to any disclaimer, the term of this patent is extended or adjusted under 35 U.S.C. 154(b) by 0 days.

(21) Appl. No.: 16/441,587

(22) Filed: Jun. 14, 2019

(65) Prior Publication Data

US 2019/0381412 A1 Dec. 19, 2019

Related U.S. Application Data

(60) Provisional application No. 62/685,620, filed on Jun. 15, 2018.

(51) Int. Cl.

| | |
|---|---|
| ***A63G 1/06*** | (2006.01) |
| ***A63G 4/00*** | (2006.01) |
| ***A63G 1/16*** | (2006.01) |
| *A61G 5/10* | (2006.01) |

(52) U.S. Cl.

CPC ..... *A63G 1/16* (2013.01); *A63G 4/00* (2013.01); *A61G 5/10* (2013.01)

(58) Field of Classification Search

CPC ... A63G 1/00; A63G 1/12; A63G 1/16; A63B 22/18

USPC ..... 472/29, 35, 40, 41

See application file for complete search history.

(56) References Cited

U.S. PATENT DOCUMENTS

| | | | | |
|---|---|---|---|---|
| 1,007,745 | A * | 11/1911 | Snell | A63G 1/08 472/40 |
| 5,795,235 | A * | 8/1998 | Ullrich | A63G 1/16 472/14 |
| 6,149,528 | A * | 11/2000 | Volz | A63G 7/00 414/921 |
| 6,171,198 | B1 * | 1/2001 | Lizama Troncoso | A63G 1/12 472/29 |
| 8,505,245 | B2 * | 8/2013 | Bobryshev | G09B 5/00 108/139 |
| 2017/0165583 | A1 * | 6/2017 | Keller | A63B 9/00 |

* cited by examiner

*Primary Examiner* — Kien T Nguyen

(74) *Attorney, Agent, or Firm* — Wesley W. Malherek; Kelly, Holt & Christenson, PLLC

(57) ABSTRACT

A rotating playground device includes a center post installed at a mounting point, located below ground such that the center post extends substantially perpendicularly above ground. The rotating playground device also includes a rotating platform rotatably coupled to the center post such that the rotating platform rotates about the center post. The rotating play device also includes a base frame coupled to the center post in a fixed relationship, such that the rotating platform is concentric with a portion of the base frame.

20 Claims, 9 Drawing Sheets

ROTATING PLAY DEVICE

CROSS-REFERENCE TO RELATED APPLICATION

The present application is based on and claims the benefit of U.S. provisional patent application Ser. No. 62/685,620, filed Jun. 15, 2018, the content of which is hereby incorporated by reference in its entirety.

BACKGROUND

Playground environments present unique design challenges. Playgrounds are designed to be low maintenance, sometimes with years between part replacement. Playgrounds also are designed to withstand high temperature differentials—snow and ice in the winter as well as extreme heat and precipitation in the summer. Playgrounds are also often designed for use by children with little or no supervision. Children learn important mobility and interpersonal skills on the playground. For that reason, it is important that interactive structures within playground environments be accessible by children with a wide variety of abilities. However, above all, it is imperative that playground structures and devices are safe for their users.

SUMMARY

A rotating playground device includes a center post installed at a mounting point, located below ground such that the center post extends substantially perpendicularly above ground. The rotating playground device also includes a rotating platform rotatably coupled to the center post such that the rotating platform rotates about the center post. The rotating play device also includes a base frame coupled to the center post in a fixed relationship, such that the rotating platform is concentric with a portion of the base frame.

These and various other features and advantages that characterize the claimed examples will become apparent upon reading the following detailed description and upon reviewing the associated drawings.

DETAILED DESCRIPTION OF ILLUSTRATIVE EMBODIMENTS

As playground structures become more inclusive, one feature that has been desired is a rotating device that can safely accommodate wheelchair-bound users, as well as non-wheelchair bound users. The rotating device must be safe for wheelchair-bound users of a variety of abilities, and can be designed such that a wheelchair-bound user can interact with the rotation mechanism that causes the device to rotate. The rotating device can also be constructed and installed such that the wheelchair-bound user can wheel themselves onto the device, and into a riding position.

For safety reasons, the rotating device should be controllable such that substantially any user can cause some rotation, but that a maximum speed is achieved that can prevent injury, or cause a user to be thrown from the device. Additionally, wheelchair accommodation areas should also have defined parking, such that the user knows when they are in a safe riding position.

It should also be able to accommodate non-wheelchair-bound users as well. While safety is a priority, it is also important that the rotating device be inclusive, such that all users feel welcome. Additionally, caretakers for wheelchair-bound users should also be able to use the rotating device.

As discussed in greater detail below, at least some of the examples presented herein address these needs. For instance, some examples allow a wheelchair-bound user to move directly onto, and off of, the rotating device, without any external transfer system. Some embodiments are configured such that the top of the platform is substantially at finished grade level such that substantially no step up or down is encountered as a wheelchair rolls from the surfacing to a platform of the rotating device. In some embodiments, the surfacing is substantially flat leading up to the rotating device. However, in other embodiments the surfacing is angled upwards toward the rotating device.

Figure 1:
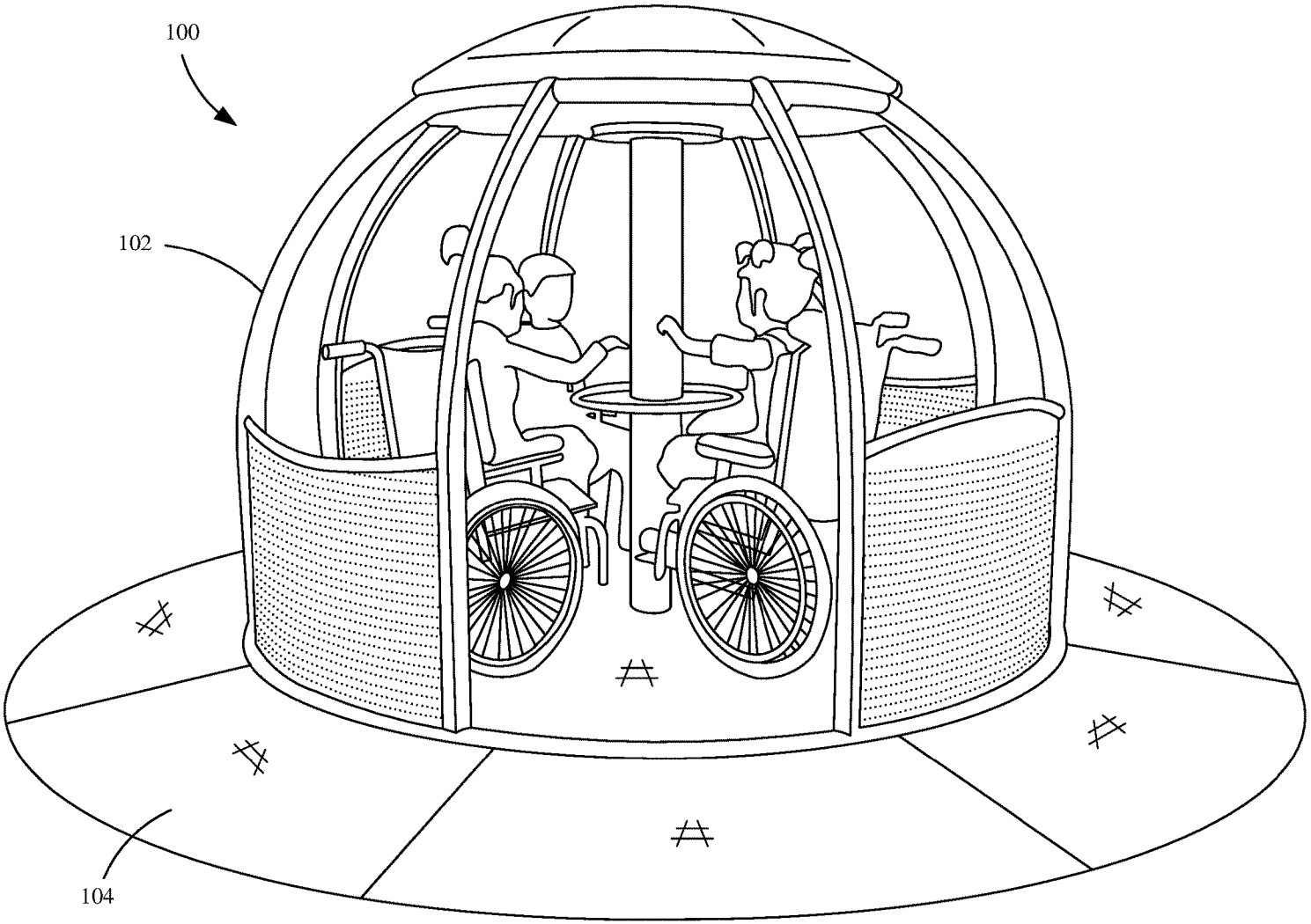
FIG. 1 is a perspective view showing an example playground environment.

FIG. 1 is a perspective view showing an example playground environment 100. Playground environment 100 includes a rotating structure 102 and a rotating surface 103 surrounded by a non-rotating surface 104. As shown, the rotating surface 103 is slightly elevated above surface 104. In other examples, surface 103 is level or near level with surface 104. As shown, four users are on rotating surface 103 within rotating structure 102. These users are of various ages and abilities and can enjoy the ride together.

Figure 2:
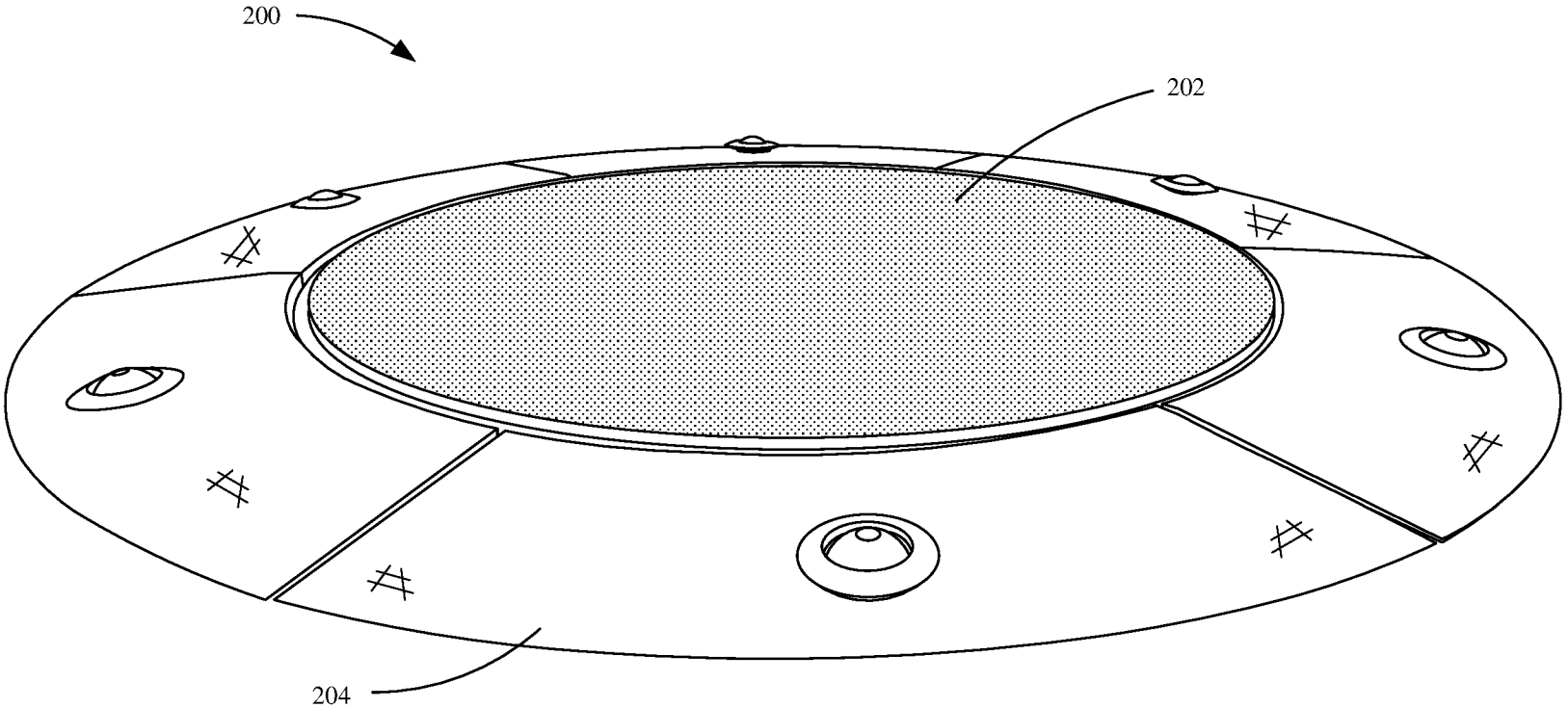
FIG. 2 is a perspective view showing an example playground environment.

FIG. 2 is a perspective view showing an example playground environment 200. Playground environment 200 includes rotating surface 202, surface 204 and surface 203. As shown rotating surface 202 and surface 204 are elevated above surface 203. In other examples, surfaces 202, 203 and 204 are equal or semi-level with one another. Rotating surface 202 is similar to rotating structure 102 of FIG. 1 and can include similar items. However, rotating surface 202 does not contain a structure or seating arrangements.

Figure 3:
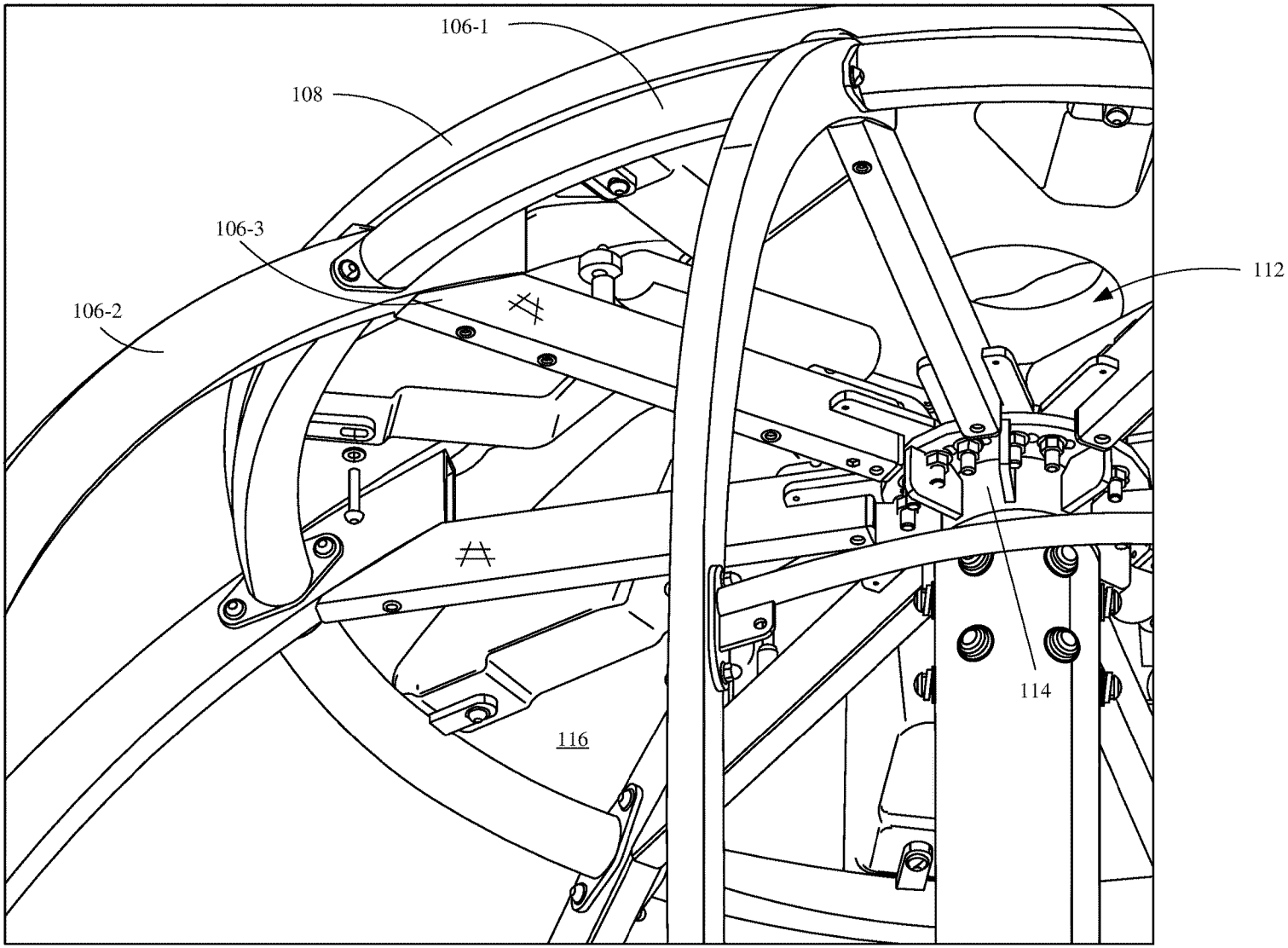
FIG. 3 is a perspective view showing an example rotational assembly.

FIG. 3 is a perspective view showing an example rotational assembly 300. It is noted that, illustratively, rotational assembly 300 is not installed below ground. As the rotational assembly 300 is designed for installation in an outdoor environment, it may be beneficial for rotational assembly 300 to be protected from exposure to the elements, which could cause premature rusting or damage. Instead, rotational assembly 300 is located on the opposite end of post 110 from the ground, (e.g., at the top of post 110). While the example shows the internal components of rotational assembly 300, this may be for illustrative purposes only. It is expressly contemplated that, in some examples, a majority of rotational assembly 300 is encased in a housing to prevent vandalism or potential injury to a user (e.g., providing panels 116, shown in FIG. 4).

Rotational assembly 300 can be provided in a playground structure such as playground structure 102 and FIG. 1. As shown frame 106 is supported by post 110 through a bearing component 114 such that frame 106 can rotate independently of post 110. Bearing component 114 includes internal ball bearings to reduce friction between frame 106 and post 110. In other examples, bearing component 114 can include other friction reducing mechanisms as well. Speed control device 112 is also coupled to post 110 and frame 106. Speed control device 112 virtually limits the speed of rotation relative between frame 106 and post 110.

Frame 106 includes various components portion such as frame portion 106-1, frame portion 106-2 and frame portion 106-3. Frame portion 106-1 is a perimeter portion that couples each adjacent vertical portion 106-2 together. Vertical portions 106-2 create a majority of the height of frame 106 and also couples frame 106 to a rotating surface. Frame portion 106-3 couples frame 106 to the bearing component 114 and speed control device 112. In other examples, frame 106 can include other or different portions as well. For example, frame portion 106-1 defines a circular frame while in other examples, frame portion 106-1 could define a different shape as well.

Figure 4:
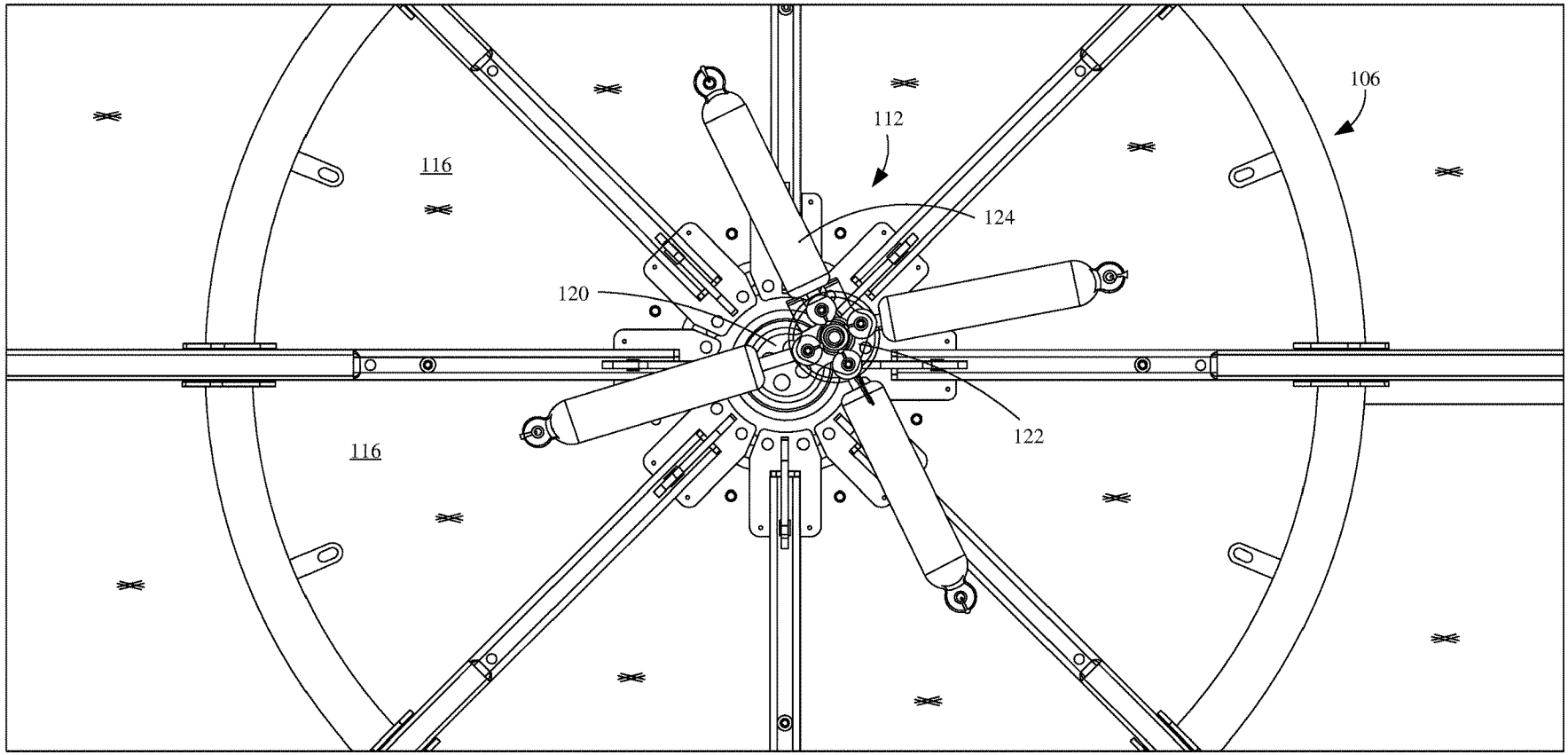
FIG. 4 is a top view of showing an example playground structure.

FIG. 4 is a top view of showing an example playground structure 400. As shown playground structure 400 includes a speed control device 112 coupled to post 110 and a rotating frame 106. Speed control device 112 restricts the speed at which rotating frame 106 rotates relative to post 110. As shown, speed control device 112 includes cylinders 124 that couple to rotating frame 106 and offset component 120 via cylinder coupler 122 (which is coupled to post 110). Cylinders 124, as shown, are pneumatic cylinders in other examples, cylinders 124 may be a different type of cylinder. When frame 106 rotates cylinders 124 are forced to continually extend and retract.

Increasing rotation of frame 106 causes continually more extensions and retractions of cylinders 124. As cylinders 124 are extended or retracted at increasing speeds the amount of force that they enact against frame 106 rotating is increased. Effectively, this increase in force limits the ability of users to accelerate frame 106 to an unsafe velocity.

Panels 116 can prove be provided to hide speed control device 112 from view of users within rotating frame 106. Panels 116 can be removed by maintenance personnel to maintain speed control device 112 while providing safety for users such that they cannot access speed control device 112 while the device is rotating.

Figure 5:
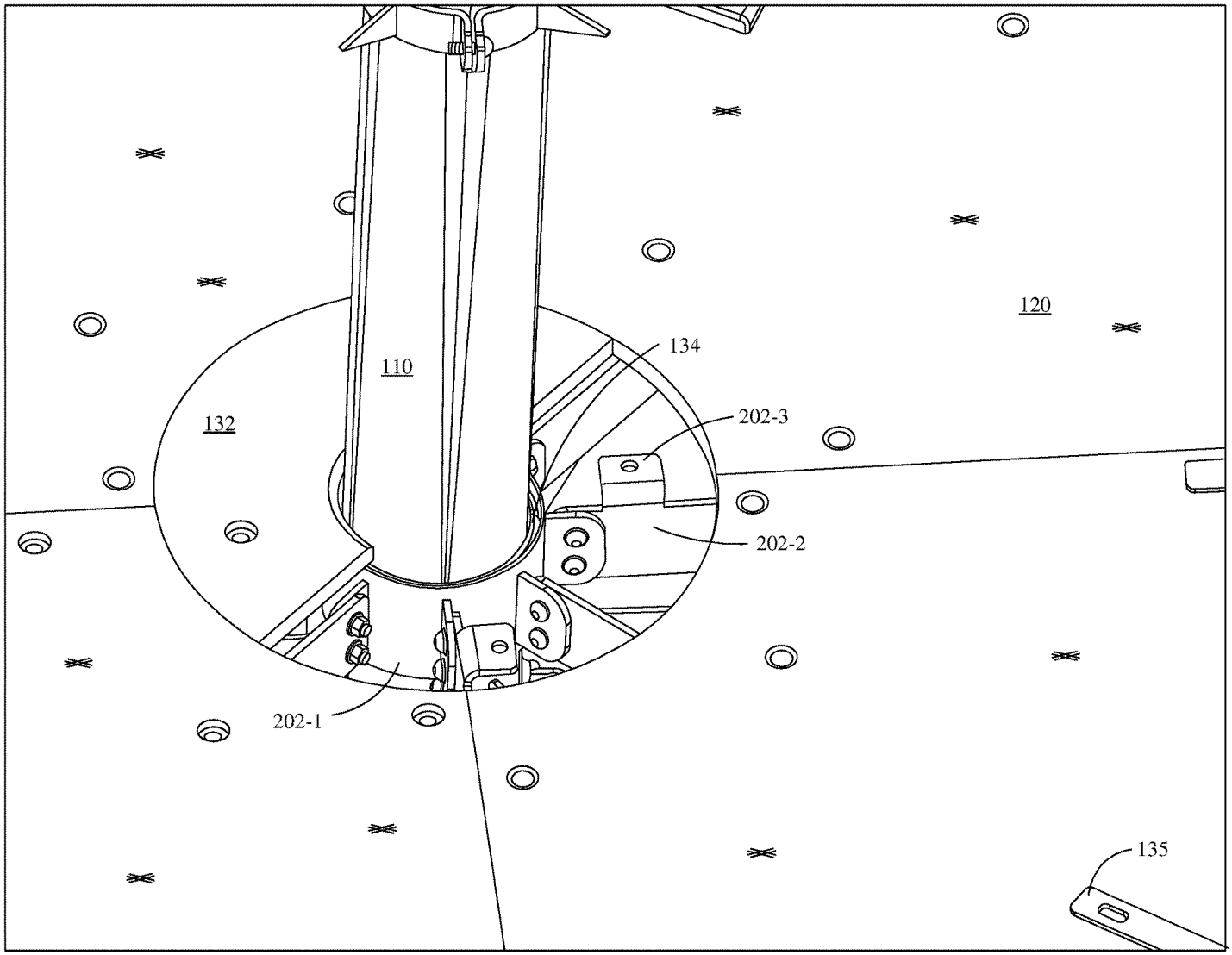
FIG. 5 is a perspective view showing an example rotating surface.

FIG. 5 is a perspective view showing a portion of an example rotating surface 130. Surface 130, as shown is a panel coupled to a rotating frame 202. Frame 202 is coupled to frame 106 and rotates with frame 106, in one example. Frame 202 is coupled to post 110 via frame portion 202-1. A bearing 134 can be before provided between post 110 and frame 202-1 such that friction between the two components is reduced. A removable surface 132 can be provided to hide the internal components of the rotating surface (e.g., bearing 134, frame 202, etc.). Surface 132 can be removed for maintenance of the components by maintenance personnel. Surface 132 also protects a user from pinch points that may be located proximate post 110. Frame 202 includes coupling mechanisms 202-3. Which, as shown, are flanges that receive fasteners to fasten either surface 130 or surface 132 to rotating frame 202. Frame 202 also includes radial supports 202-2. Radially protrude from post 110 and support surface 130. Surface 130 also includes surface features 136 which, as shown, is a weight coupled to the surface 130. Surface feature 136 allows a wheelchair bound user to use the rotating play device without having to be strapped into a component of the rotating structure. Instead, surface feature 136 provides an obstruction such that a wheel cannot easily roll over it.

Figure 6:
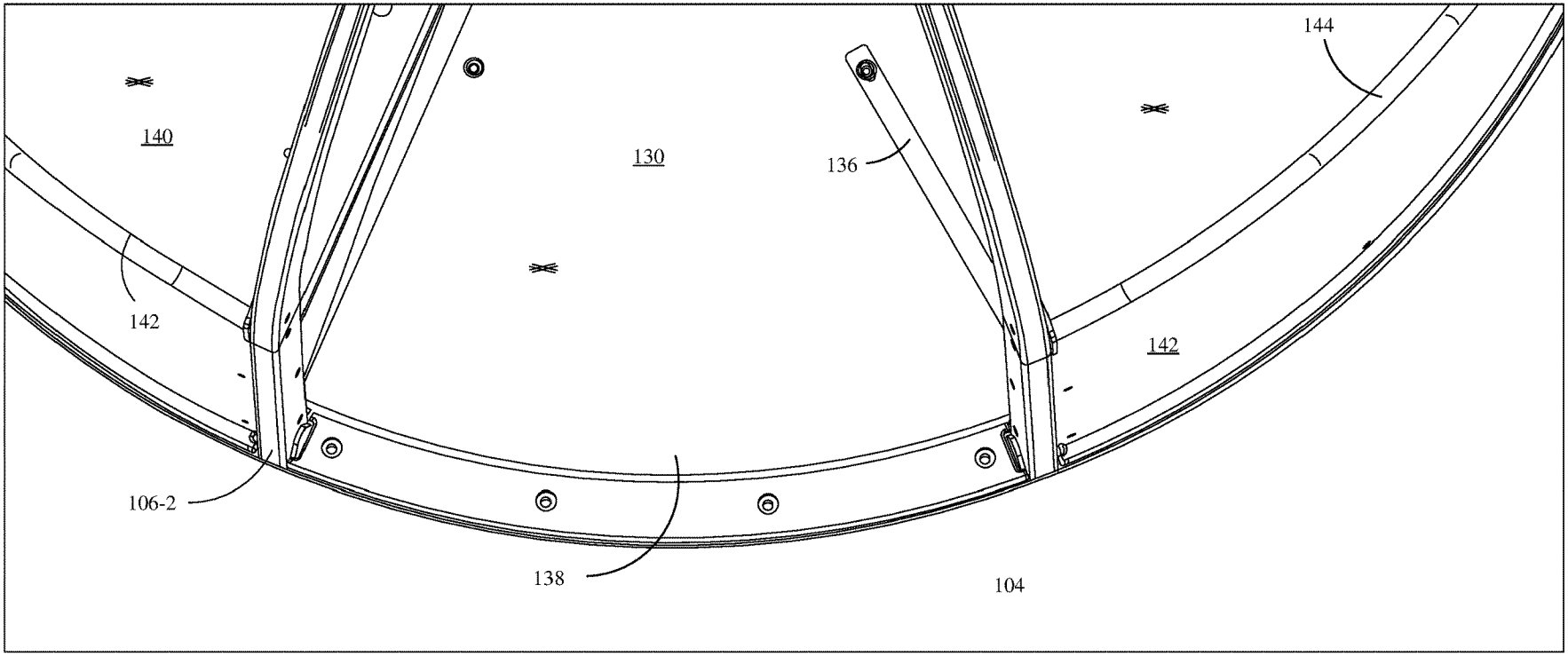
FIG. 6 is a top perspective view showing an example surface configuration.

FIG. 6 is a top perspective view showing an example surface configuration 600. Chair 140 and surface feature 136 are both coupled to surface 130 and rotate with surface one. Coupled to surface 130 are surface feature 156, chair 140, panels 142, frame 144, frame 106. All of these components rotate with one another. During rotation a distance between surface 130 and surface 104 is ideally maintained such that it does not create a pinch point. Adjustable surface 138 allows for virtual adjustment of surface 130 to maintain a given distance between surface 130 and surface 104. Panels 142 provide a wall between surface 130 and rotating surface 130 and stationary surface 104 such that a user has to crossover adjustable surface 138 to get either on or off rotating surface 130. Which minimizes the places where a pinch point can be created. Panels 142 also keep users on secure on rotating surface 130 during rotation.

Additionally, because the rotational device is designed to be used in an outdoor environment, some examples are configured to handle heat-induced expansion and contraction of materials. As shown, the platform comprises two separate surfacing components—platform 130, and adjustable platform 138. Adjustable platforms 138 can be configured to be separately installed from the decking components. As illustrated, adjustable platforms 138 include large installation apertures which are larger than mechanically required. This provides adjustability during installation, to ensure that gap is maintained about the structure, and also better tolerates expansion and contraction during daily and seasonal temperature changes. In one example, adjustable surface 138 includes a polymeric material. In one example, adjustable surface 138 includes a plastic material.

Figure 7:
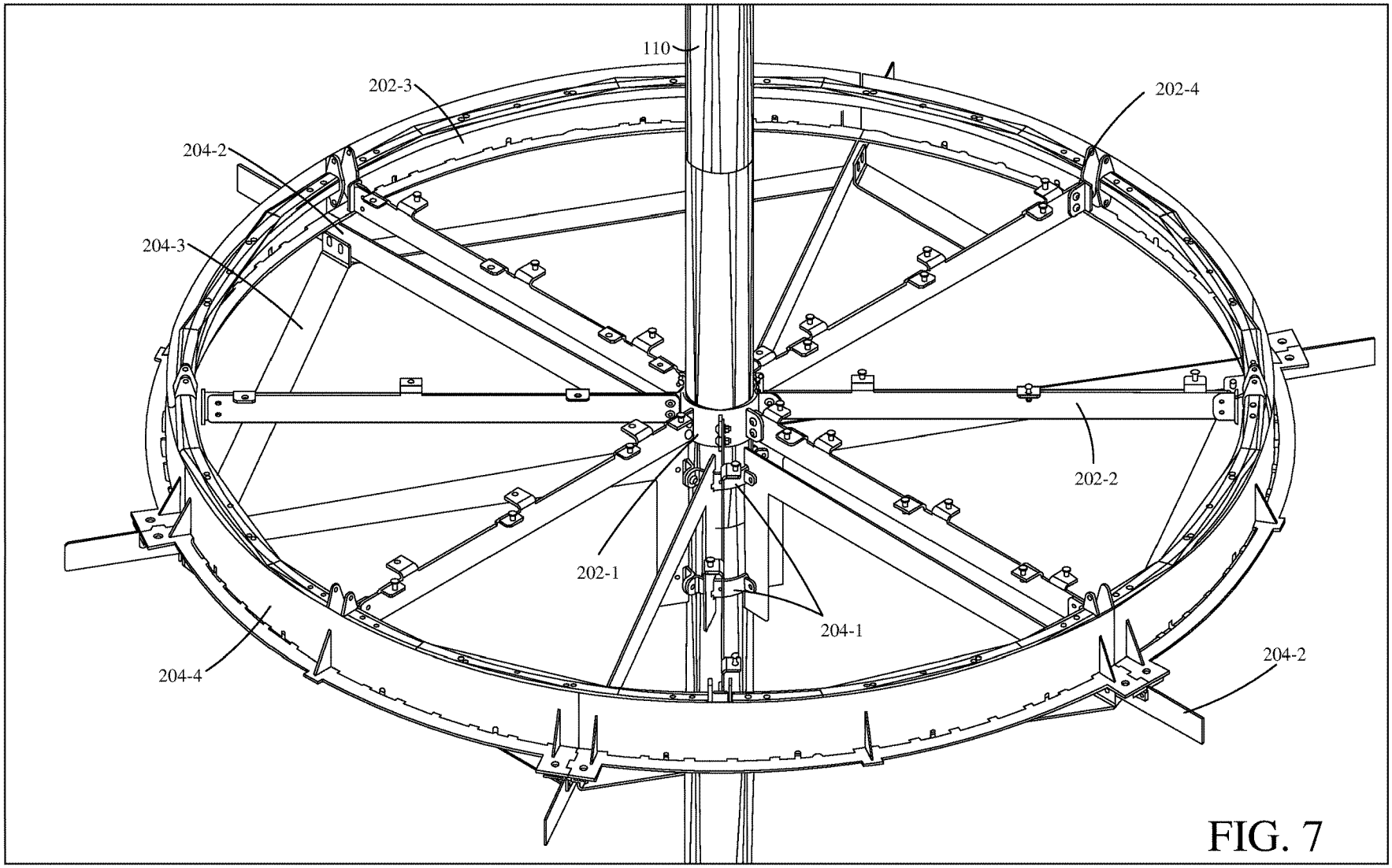
FIG. 7 is a perspective view showing an example structure for a rotating playground device.

FIG. 7 is a perspective view showing an example structure 700 for a rotating playground device. As shown, post 110 is at the center of structure 700. Post 110 is configured to be installed securely into the ground (e.g. via a concrete footer or burial or bolted connection to the ground.). Coupled to post 110 is a base frame 204. Base frame 204 includes post clamps 204-1 that secure radial base components 204-2 to post 110. Base radial components 204-2 are L-shaped and which allows them to align better with post 110. If post 110 is plum or near plum base radial portions 204-2 will be in an ideal orientation for drainage and other advantages. Base radial portions 204-2 are coupled to one another via base portions 204-3. These portions 204-3 provides support between portions 204-2. Base radial portions 204-2 also coupled to base skirt portions 204-4. Base skirt portions 204-4 retain the rotating frame 202. In some examples, portions of base 204 are filled with gravel and/or concrete. For example, playground surfacing can be provided about the exterior of base skirt portions 204-4 up to the top of the skirt portion 204-4 such that a level surface between the exterior playground surface and the rotating surface is formed. Because of how base 204 is coupled to post 110 an easier assembly is possible.

Also coupled to post 110 is rotating frame 202. Rotating frame 202 couples to post 110 via rotating frame portion 202-1. Radial frame portions 202-2 to the extend outward from frame portions 202-1. A rotating surface couples to frame portion 202-2 for users to ride on. Since both frame 202 rotating and stationary base frame 204 are coupled to post 110 a fixed relationship between the rotating frame 202 and base frame 204 is created. This fixed relationship allows for easier installation resulting in a rotating platform that will be concentric and level with the top of the skirting. In one example, the exterior surfacing is level with the skirting and accordingly the platform is also level with the exterior surfacing. Because frame portions 202-2 are coupled to the post, at a perpendicular angle, and then coupled to the skirting as illustrated, the rotating device will still function correctly, and safely, even post 110 is not perfectly plumbed. For example, the skirting and rotating platform remain will concentric. Additionally, the adjustability of the skirting during installation ensures that the gap created between skirting 204-4 and platform is no greater than 5/16th of an inch.

Figure 8:
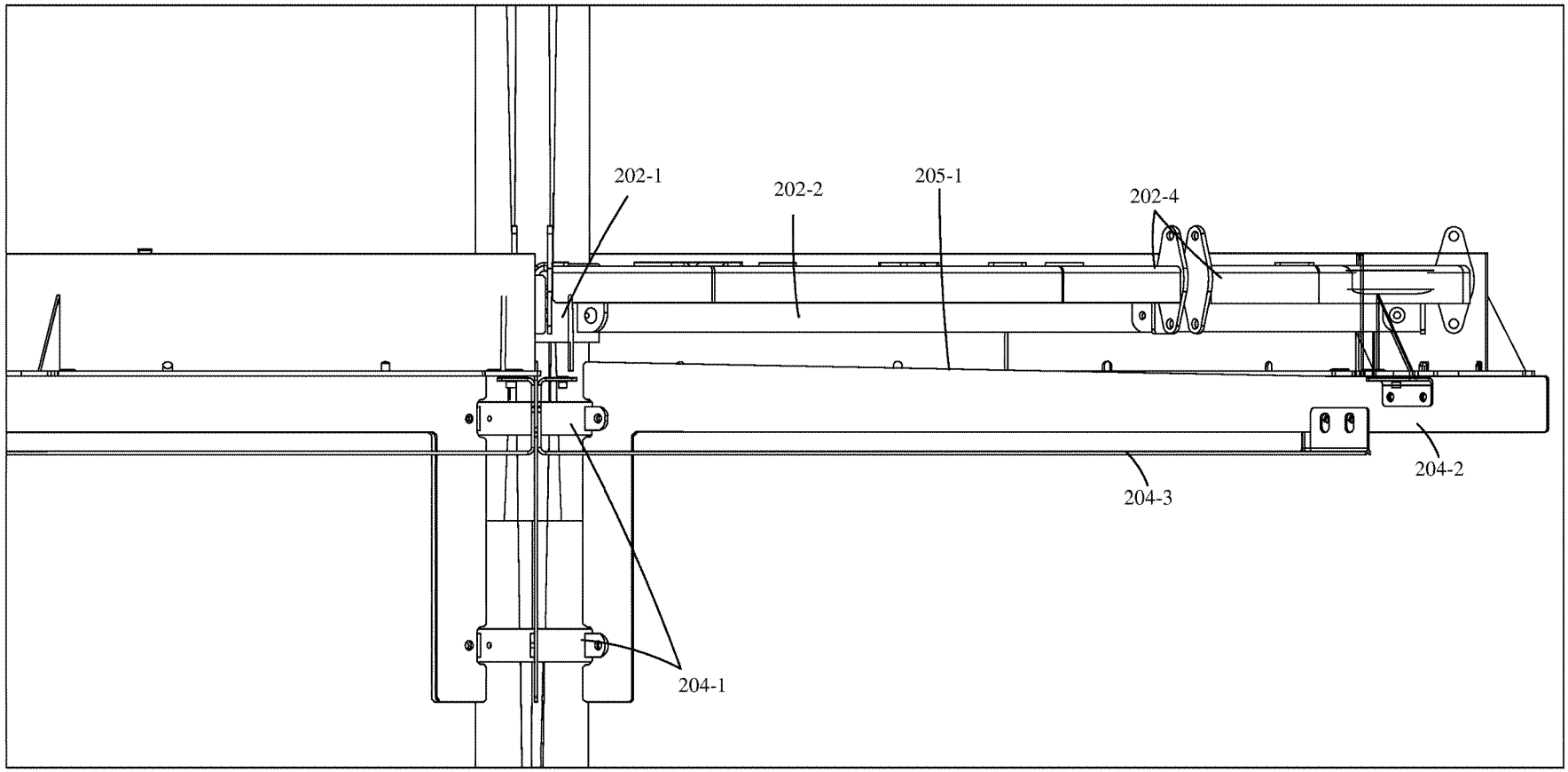
FIG. 8 is a side view showing an example frame assembly.

FIG. 8 is a side view showing an example frame assembly 800. shown, base radial portion 204-2 has a top surface 205-1 that has a slight incline towards post 110. This incline provides a guide surface for fill to be placed in between radial base portions 204-2 and old which allows for ideal drainage. In one example, the sloping is approximately 1°. However, greater sloping, for example 2°, 3°, or more, may be appropriate to assist with higher anticipated drainage needs.

Base initial portion 204-2 also has a guide surface guide edge 205-2 that aligns with post 110. When guide edge 205-2 is aligned with a plum post 110, base radial portion 204-2 is in a correct orientation. This guide edge 205-2 is useful for easier installation.

Figure 9:
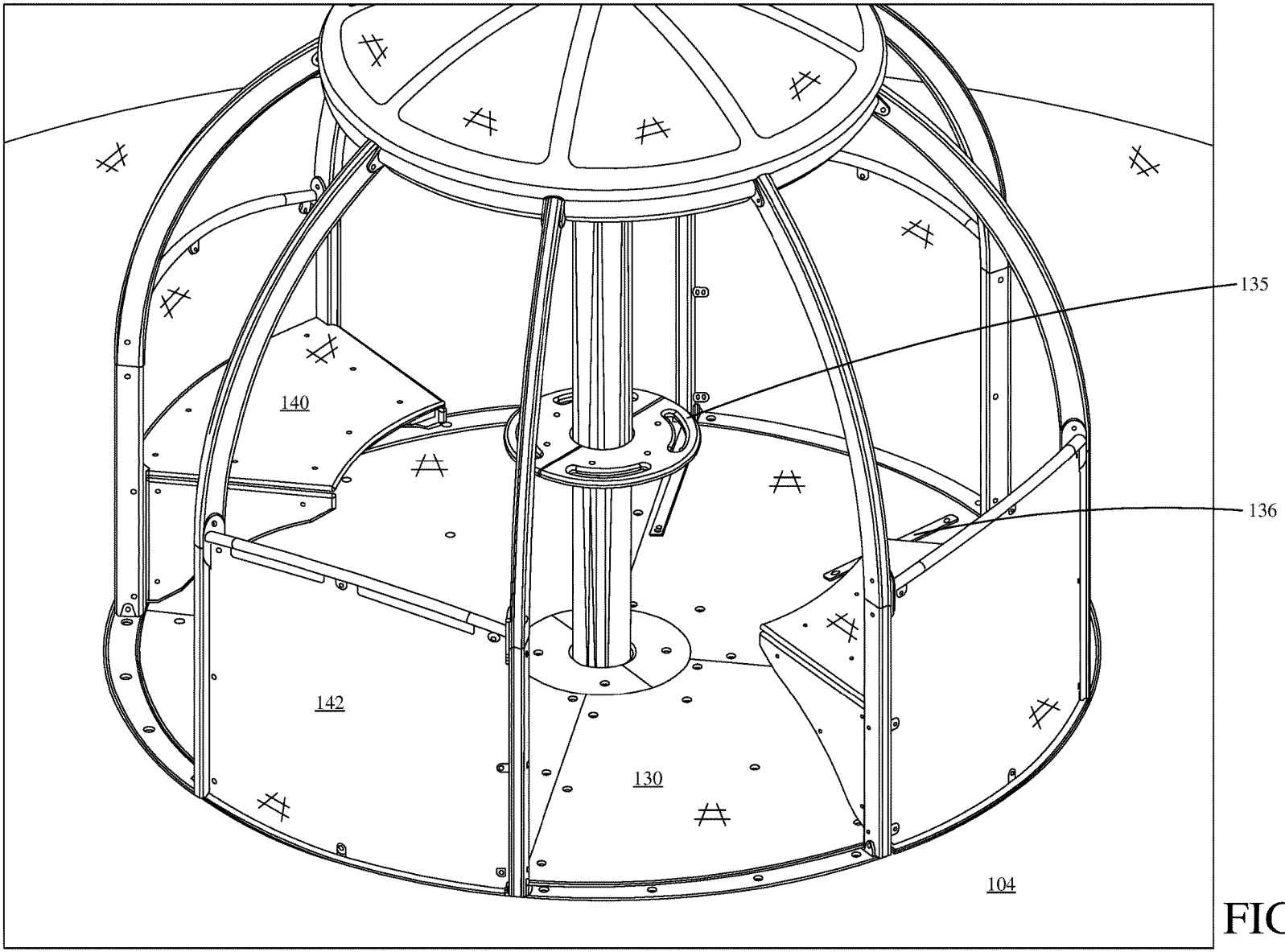
FIG. 9 is a perspective view showing an example seating arrangement.

FIG. 9 is a perspective view showing an example seating arrangement 900. As shown, seating arrangement 900 includes two seats 140 and two surface features 136. In other examples, there be more or less seats 140 or surface features 136. In other examples, there may be different configurations of seat 140 or surface features 136. As shown, seats 140 and surface features 136 are disposed on rotating surface 130 such that a user in one of the seats 140 or surface features 136 can reach turntable 135. Turntable 135 is coupled to post 110 which is stationary while the structure rotates allowing a user can grab turntable 135 and push or pull to create rotational motion relative to the turntable 135.

Panel 142 can be used as a backstop configured to keep a wheelchair within the housing of the rotating device. Additionally, in some embodiments, surface feature 136 can be used as indicia that provides notice that a wheelchair is in a secure place. For instance, surface feature 136 can include a PVC-coated strip is placed on surface 130 such that, as the wheelchair rolls over the strip, and into place, the user feels the transition. This strip can also keep the wheelchair in place. Many previous designs rely on straps and/or bumpers to keep a wheelchair in place. However, the backstop allows for a wheelchair rider to enjoy the ride without having to hold on to anything. The backstop also allows for increased visibility of the wheelchair-based rider, with an ability to sit omni-directionally—for example facing inward, outward, tangentially, etc. based on their preference, not as limited by a design construction.

Although the present invention has been described with reference to preferred embodiments, workers skilled in the art will recognize that changes may be made in form and detail without departing from the spirit and scope of the invention.

What is claimed is:

1. A rotating playground device comprising:

a center post installed at a mounting point, located below ground such that the center post extends substantially perpendicularly above ground;

a rotating platform rotatably coupled to the center post such that the rotating platform rotates about the center post;

a base frame coupled to the center post in a fixed relationship, such that the rotating platform is concentric with a portion of the base, frame.

2. The rotating playground device of claim 1, wherein the rotating platform is substantially at the same grade as a surrounding surfacing material.

3. The rotating playground device of claim 1, further comprising a progressive braking system.

4. The rotating playground device of claim 3, wherein the progressive braking system is coupled to the center post above the rotating platform.

5. The rotating playground device of claim 1, further comprising a rotating structure to the rotating platform, the rotating structure being positioned in a same imaginary plane with the base frame, said same imaginary plane passing through the center post so as to be oriented perpendicularly relative to the center post.

6. The rotating playground device of claim 1, further comprising a seating area with a backstop.

7. The rotating playground device of claim 1, further comprising a user engagement mechanism, coupled to the center post, and configured to be utilized by a user to initiate rotation of the rotating platform.

8. The rotating playground device of claim 1, wherein the base frame comprises a plurality of skirt portions.

9. The rotating playground device of claim 1, wherein the base frame comprises radial portions that extend outward from the center post.

10. The rotating playground device of claim 9, wherein the radial portions comprise a sloped top edge.

11. The rotating playground device of claim 10, wherein the sloped top edge has a slope greater than 1 degree.

12. The rotating playground device of claim 11, further comprising fill that is disposed between the radial portions.

13. The rotating playground device of claim 1, wherein the rotating platform comprises an adjustable portion.

14. The rotating playground device of claim 1, wherein the rotating platform comprises a textured plastic material.

15. A rotating playground device comprising:

a center post;

a rotating structure coupled to, supported by, and configured to rotate around the center post; and a base structure that substantially surrounds the rotating structure, the base structure being coupled to the center post so as prevent rotation of the base structure around the center post.

16. The rotating playground device of claim 15, wherein the base frame structure includes a skirting that is spaced 5/16th of one inch or less from a portion of the rotating structure.

17. The rotating playground device of claim 15, wherein the rotating structure comprises: a rotating platform having an adjustable portion.

18. The rotating playground device of claim 15, further comprising a progressive braking system disposed above the center post.

19. A rotating playground device comprising:

a center post;

a rotating structure coupled to, and supported by, the center post;

a rotating surface coupled to the rotating structure; and a plurality of base skirt portions disposed about the center post concentrically with the rotating surface, the plurality of base skirt portions being fixed to the center post such that the plurality or base skirt portions is not rotatable around the center post.

20. The rotating playground device of claim 19, further comprising:

a seat coupled to the rotating structure; and a surface feature coupled to the rotating surface and configured to receive a wheel of, a wheelchair.

* * * * *